US010563326B2

(12) United States Patent
Griesshammer et al.

(10) Patent No.: US 10,563,326 B2
(45) Date of Patent: Feb. 18, 2020

(54) TEXTILE MACHINE FOR PRODUCING ROVING AND METHOD FOR STARTING THE ROVING PRODUCTION ON A CORRESPONDING TEXTILE MACHINE

(71) Applicant: Maschinenfabrik Rieter AG, Winterthur (CH)

(72) Inventors: Christian Griesshammer, Winterthur (CH); Jiri Stech, Usti nad Orlici (CZ); Petr Haska, Ceska Trebova (CZ)

(73) Assignee: Maschinenfabrik Rieter AG, Winterthur (CH)

( * ) Notice: Subject to any disclaimer, the term of this patent is extended or adjusted under 35 U.S.C. 154(b) by 624 days.

(21) Appl. No.: 15/309,457

(22) PCT Filed: Apr. 14, 2015

(86) PCT No.: PCT/IB2015/000479
§ 371 (c)(1),
(2) Date: Nov. 8, 2016

(87) PCT Pub. No.: WO2015/170155
PCT Pub. Date: Nov. 12, 2015

(65) Prior Publication Data

US 2017/0152125 A1 Jun. 1, 2017

(30) Foreign Application Priority Data

May 8, 2014 (CH) ..... 696/14

(51) Int. Cl.
*D01H 1/40* (2006.01)
*B65H 54/02* (2006.01)
*B65H 65/00* (2006.01)

(52) U.S. Cl.
CPC ..... *D01H 1/40* (2013.01); *B65H 54/02* (2013.01); *B65H 65/005* (2013.01); *B65H 2701/31* (2013.01)

(58) Field of Classification Search
CPC .. B65H 65/005; B65H 54/02; B65H 67/0422; D01H 1/40
See application file for complete search history.

(56) References Cited

U.S. PATENT DOCUMENTS 3,681,905 A * 8/1972 Furtmeier ..... D01H 1/40 242/472.6
4,028,874 A 6/1977 Maag et al.
(Continued)

FOREIGN PATENT DOCUMENTS

CH 705237 A1 4/2013
DE 24 47 715 A1 4/1976
(Continued)

OTHER PUBLICATIONS

PCT Search Report, dated Jul. 24, 2015.
Swiss Search Report, dated Oct. 15, 2014.

*Primary Examiner* — Shaun R Hurley
(74) *Attorney, Agent, or Firm* — Dority & Manning, P.A.

(57) ABSTRACT

A textile machine and associate method are provided for producing a roving, wherein a consolidating means produces a roving having a protective twist from a fiber bundle. A winding device is arranged downstream of the consolidating means in a transport direction of the roving and winds the roving onto a tube driven by a tube drive. An arrangement is disposed to bring the roving leaving the consolidating means during a roving production start procedure into contact with the tube. The arrangement includes a movably mounted suction unit with a suction opening that is configured to suck up the roving during ongoing roving production. Means are provided to bring the roving running
(Continued)

between the consolidating means and the suction opening into contact with the tube during ongoing roving production. Means are further provided to cut the roving such that a section of the roving grasped by the suction unit is conveyed away by the suction unit and a section of the roving running between the consolidating means and the tube is wound onto the tube.

14 Claims, 7 Drawing Sheets

(56) References Cited

U.S. PATENT DOCUMENTS

| | | | | |
|---|---|---|---|---|
| 4,317,545 | A | 3/1982 | Burysek et al. | |
| 4,501,116 | A | 2/1985 | Schuller et al. | |
| 5,119,996 | A * | 6/1992 | Stahlecker | D01H 15/013 242/472.8 |
| 2009/0289141 | A1 | 11/2009 | Griesshammer et al. | |
| 2014/0239114 | A1 | 8/2014 | Haska et al. | |
| 2014/0284415 | A1* | 9/2014 | Griesshammer | B65H 54/543 242/474.6 |
| 2015/0082766 | A1 | 3/2015 | Stahlecker et al. | |
| 2017/0096752 | A1* | 4/2017 | Griesshammer | D01H 9/18 |
| 2017/0096753 | A1* | 4/2017 | Griesshammer | D01G 15/46 |
| 2017/0101287 | A1* | 4/2017 | Griesshammer | B65H 63/02 |
| 2017/0152124 | A1* | 6/2017 | Haska | B65H 54/02 |
| 2017/0247817 | A1* | 8/2017 | Haska | B65H 67/048 |

FOREIGN PATENT DOCUMENTS

| | | | |
|---|---|---|---|
| DE | 30 04 163 | A1 | 8/1980 |
| DE | 32 37 989 | A1 | 7/1983 |
| DE | 39 09 422 | A1 | 10/1990 |
| DE | 102 41 578 | A1 | 3/2004 |
| DE | 10 2012 102 695 | A1 | 10/2013 |
| EP | 0 025 340 | A1 | 3/1981 |
| EP | 0 069 205 | A1 | 1/1983 |
| EP | 0 375 242 | A2 | 8/1990 |
| EP | 1 561 717 | A1 | 8/2005 |
| EP | 2 112 258 | A2 | 10/2009 |
| WO | WO 98/02375 | A1 | 1/1998 |
| WO | WO 2009/033438 | A2 | 3/2009 |
| WO | WO 2009/086646 | A1 | 7/2009 |
| WO | WO 2013/010279 | A1 | 1/2013 |

* cited by examiner

TEXTILE MACHINE FOR PRODUCING ROVING AND METHOD FOR STARTING THE ROVING PRODUCTION ON A CORRESPONDING TEXTILE MACHINE

FIELD OF THE INVENTION

The present invention relates to a textile machine for producing roving, having at least one consolidating means by which a roving having a protective twist is produced from a fiber bundle that is fed to the consolidating means, and a winding device, arranged downstream of the consolidating means in a transport direction of the roving, for winding the roving produced by the consolidating means onto a tube driven by a tube drive. A method for operating such a textile machine is also proposed.

BACKGROUND

Roving is produced from slivers which are usually pretreated (for example doubled) by drafting and serves as a precursor for the subsequent spinning process, in which the individual fibers of the roving are spun, for example by means of a ring spinning machine, to form a fiber yarn. In order to give the roving the strength necessary for the further processing, it has proven to be advantageous, during production of the roving, to draft the submitted fiber bundle by means of a drafting system, which is usually part of the textile machine in question, and then to provide it with a protective twist. This strength is important in order to prevent tearing of the roving during the winding onto a tube and/or during the feeding thereof to the downstream spinning machine. The protective twist that is given must on the one hand be sufficient to ensure that the individual fibers hold together during the individual winding and unwinding processes and corresponding transport processes between the respective types of machine. On the other hand, it must also be ensured that, despite the protective twist, the roving can be further processed in a spinning machine—the roving must therefore still be able to be drafted.

For producing such a roving, use is primarily made of so-called flyers, the delivery speed of which is nevertheless limited due to centrifugal forces that occur. There have therefore already been many proposals for circumventing the flyers or replacing them with an alternative type of machine (see for example EP 0 375 242 A2, DE 32 37 989 C2).

In this connection, it has also already been proposed, inter alia, to produce roving by means of air-jet spinning machines, in which the protective twist is created by means of swirled air flows. The basic principle here consists in guiding a fiber bundle through a consolidating means designed as an air spinning nozzle, in which an air vortex is generated. This ultimately brings about the situation whereby some of the outer fibers of the supplied fiber bundle are wrapped as so-called wrapping fibers around the centrally running fiber strand, which in turn consists of core fibers running substantially parallel to one another.

Another method for roving production is disclosed in DE 24 47 715 A1. The consolidation of the unconsolidated fiber bundle described therein takes place by a consolidating means that brings about not a twisting, but rather a helical wrapping of a sliver with one or more filament yarns, preferably monofilament yarns, which hold the fiber bundle together and give it its strength. The spirals of the individual filament yarns may in this case be arranged in the same direction or in opposite directions. Preference is given to two filament yarns that are arranged in opposite directions of rotation and in a manner crossing over one another. The roving produced in this way is thus composed essentially of a sliver of parallel staple fibers and one or more fine-titer filament yarns wrapping helically around the sliver.

There are various possibilities for wrapping the filament yarn or filament yarns around the unconsolidated fiber bundle. For example, the filament yarn can be applied to small bobbins of small diameter. The filament yarn is then drawn off from the stationary bobbin and drawn through the bobbin axis together with the fiber bundle, whereby the filament yarn is wrapped around the fiber bundle and the number of windings drawn off from the bobbin corresponds to the number of wraparounds applied to the fiber bundle. In principle, it is also possible to design the consolidating means in such a way that only the unconsolidated fiber bundle is guided through the bobbin axis, so as consequently to relocate the winding process to behind the filament yarn bobbin. The wrapping point should in this case be defined by a suitable thread guide.

Another method for producing roving is described in WO 2009/086646 A1, wherein the method comprises the following steps: 1) providing a fiber bundle in the form of two, preferably untwisted, slivers, 2) applying S and Z twists over alternating regions of the two slivers, wherein regions of S and Z twists on the respective sliver are separated by regions without any twist, and 3) bringing together the two slivers provided with S and Z twists to form a roving, wherein the two slivers automatically twist together on account of their tendency to twist back.

The S and Z twists may be created, for example, by means of two elements of the consolidating means used, which hold the respective sliver in a clamped manner, wherein at least one element, preferably both elements, apply opposite twists on the sliver in an alternating manner on both sides by a relative movement on the surface thereof transversely to the longitudinal direction of the sliver. At the same time, the respective sliver is moved in the sliver direction. However, the S and Z twists can also be created by means of an aerodynamic, in particular pneumatic, method.

The alternating S and Z twists are moreover interrupted by intermediate regions without any twist. The two slivers provided with S and Z twists in the same way are finally brought together at the so-called joining point. Here, the slivers start to twist together automatically, that is to say they wind around each other. This so-called double-folding maintains the S and Z twists in the individual slivers, so that a self-stabilizing two-component roving is obtained. In principle, however, care should be taken here to ensure that the regions without any twist in the first sliver should be arranged offset in the longitudinal direction relative to the regions without any twist in the second sliver, so that two regions without any twist in the first and second sliver never lie next to one another in the resulting roving, since the strength of the roving depends substantially on the phase position of the regions without any twist in the two slivers. As described above, the rovings are therefore always brought together by the consolidating means in such a way that their regions without any twist lie out of phase. The roving produced in this way ultimately has a greater strength than an untwisted fiber bundle, the strength ultimately being sufficient to wind the roving onto a bobbin and unwind it again from the latter without false drafts.

However, one critical aspect, among others, in the method is the roving production start procedure, during which the roving leaving the consolidating means must be brought into contact with an empty tube in order ultimately to be able to wind it onto the driven tube.

SUMMARY OF THE INVENTION

It is therefore an object of the present invention to propose a method for starting the roving production on a textile machine, as well as a textile machine for producing roving, with which such a start procedure can be carried out. Additional objects and advantages of the invention will be set forth in part in the following description, or may be obvious from the description, or may be learned through practice of the invention.

The objects are achieved by a textile machine and by a method for starting the roving production on a textile machine having the features described herein.

According to the invention, the proposed textile machine is characterized in that it has an arrangement by which the roving leaving the consolidating means during a roving production start procedure can be brought into contact with the tube. The arrangement includes a movably mounted suction unit with a suction opening, by means of which the roving can be sucked up after passing the consolidating means during ongoing roving production. To this end, the suction unit is preferably connected to a negative pressure source that is jointly provided for a plurality of consolidating means or is provided separately for each consolidating means, so that in the region of the suction opening an air flow directed into the suction opening can be generated, by which the roving can be sucked up after leaving the consolidating means. The aim of the suction unit is essentially to suck up the roving coming out of the consolidating means during the start of roving production and to pick it up and optionally convey it away at least until the roving has been brought into contact with the tube according to the following description in order to be wound up by the latter.

In addition, the arrangement comprises means by which the roving running between the consolidating means and the suction opening during the roving production start procedure can be brought into contact with the tube during ongoing roving production (that is to say, while the consolidating means is active and is producing a roving). In this connection, mechanically or else pneumatically operating devices may be used that allow a movement of the roving in the direction of the tube and thereby bring about the contact between the roving and the tube that is necessary to begin the winding process (wherein the tube may have a contact section having a plurality of hooks that fix the roving to the tube surface).

Finally, the arrangement comprises means by which the roving, during ongoing roving production, can be cut such that the section of the roving that is grasped by the suction unit can be conveyed away by the suction unit and the section of the roving running between the consolidating means and the tube can be wound onto the tube. As will be described in more detail below, this may be a separate cutting unit that is moved into the course of the roving. It is also conceivable to bring about the cutting of the roving with the aid of the suction unit, by means of which a tension that is necessary for cutting the roving can be exerted on the roving.

As a result, the textile machine comprises all the devices necessary for a successful roving production start procedure, that is to say for connecting to the tube the roving leaving the consolidating means at the start of roving production, for cutting the roving in a defined region, and for winding the roving section on the consolidating means side (that is to say the roving section which runs between the consolidating means and the winding device after the roving has been cut) onto the tube.

At this point, it should be pointed out in general (and thus also in connection with the method according to the invention which will be described in more detail below) that the consolidating means may be designed in various ways. For example, it would be conceivable that the consolidating means is suitable for producing the roving in the manner described in the abovementioned documents WO 2009/086646 A1 and DE 24 47 715 A1.

Preferably, however, the textile machine is designed as an air-jet spinning machine and the consolidating means is designed as an air spinning nozzle, by means of which the protective twist in the roving is created, as described above, by means of swirled air flows (part of such a textile machine designed as an air-jet spinning machine is described by way of example in the description of the figures).

It is advantageous if the textile machine has a draw-off unit, arranged downstream of the consolidating means in the transport direction of the fiber bundle, for drawing off the roving from the consolidating means, wherein the draw-off unit may comprise, for example, two draw-off rollers that can be pressed against one another and at least one of which can be set in a rotational movement by means of a drive in order to be able to guide the roving between the two draw-off rollers in a clamped manner. The roving in this case, during ongoing roving production, can be sucked up by the suction unit after passing the draw-off unit. Furthermore, the roving running between the draw-off unit and the suction opening can be brought into contact with the tube by means of the above-described arrangement during ongoing roving production, wherein the roving, during ongoing roving production, can be cut such that the section of the roving that is grasped by the suction unit can be conveyed away by the suction unit, and the section of the roving running between the draw-off unit and the tube can be wound onto the tube by the means already mentioned or yet to be mentioned in detail below. At least one of the draw-off rollers is moreover preferably operatively connected to a load relief element (for example a pneumatic unit, an electromagnet, or a tension or compression spring), by means of which the draw-off rollers or one of the draw-off rollers can be brought into a load-relieved position in which a gap exists between the draw-off rollers (in contrast to this, the draw-off rollers are pressed against one another in their loaded position). Such a configuration ultimately makes it possible that the draw-off rollers are in their load-relieved position during the start of roving production (that is to say at the time at which the roving begins to exit from the consolidating means). The roving can in this case run through between the two draw-off rollers without any undesired collision occurring between the roving and the draw-off rollers. Once the roving or the initial section thereof has passed the draw-off rollers, the draw-off rollers can finally be moved into their loaded position in order to be able to draw the roving out of the consolidating means.

In this connection, advantages are obtained if the roving running between the consolidating means and the suction opening, or the roving running between the draw-off unit (if present) and the suction opening, can be brought into contact with the tube by means of a traversing unit, wherein the traversing unit is designed to grasp the section of the roving running between the consolidating means and the suction opening during the roving production start procedure or, if a draw-off unit is present, the section of the roving running between the draw-off unit and the suction opening, and to move it in the direction of the tube. The traversing unit may comprise for example a traversing arm with a guide section, by means of which the roving can be gripped and then can be guided on a predefined path. The traversing arm may be mounted for example such as to be able to rotate or pivot about an axle in order to be able to move the roving in the direction of the tube after contact has been made between the guide section and the roving. In order to allow the traversing, that is to say the continuous movement of the roving in the direction of the rotation axle of the tube, in particular during the process of winding the roving onto the tube, the traversing arm may moreover be mounted such as to be able to move back and forth along an axle.

It is also advantageous if the textile machine comprises a movably mounted cutting unit, by means of which the roving can be cut during ongoing roving production. The cutting unit is preferably movable from a resting position, in which it is not in contact with the roving during the roving production start procedure, into a cutting position, in which it comes into contact with the roving and thereby cuts the roving. In this case, during the changeover between resting position and cutting position, the cutting unit may be able to be moved into the course of the roving, that is to say a region between the tube surface and the suction opening of the suction unit. When contact occurs between the roving and the cutting unit, a local braking of the roving occurs in the region of the cutting unit. However, since the roving is already in contact with the rotating tube and is being wound up by the latter, the tension acting on the roving section running between the tube and the suction opening ultimately increases and the desired tearing (=cutting) of the roving occurs.

It is also extremely advantageous if the cutting unit in the cutting position can be brought into contact with the tube and is designed thereby to press the roving against the tube surface. As already described, the tube surface may have one or more surface sections that have a plurality of hooks or similar elements to ensure that the roving coming into contact with the surface section in question is securely held. If the cutting unit can be brought into contact with the tube or with this section of the surface thereof, then the roving can be pressed against the hooks (or similar elements) during the roving production start procedure. As a result, it is ultimately ensured that the roving is securely gripped by the tube and accordingly wound up.

Advantages are also obtained if the cutting unit comprises a movably mounted cutting arm that is movable, preferably pivotable, from the resting position in the direction of the tube. For example, the cutting unit could comprise a pivotable cutting arm which, during the cutting process, can be abruptly pivoted into the course of the roving which, at this point in time, runs between the suction opening of the suction unit and the tube. Moreover, the drive for the pivoting arm should be designed to move the pivoting arm back into the resting position, or into an intermediate position differing from the cutting position, as quickly as possible after reaching the cutting position (preferably within a time period of less than 3 seconds, preferably less than 2 seconds, particularly preferably less than 1 second), so as to avoid influencing the roving winding process.

It is also advantageous if the suction unit comprises a suction nozzle that has a suction opening and is pivotable about a rotation axle, wherein the rotation axle encloses with the horizontal an angle $\alpha$ of between 0° and 30°, preferably between 0° and 20°, particularly preferably between 0° and 15°. The rotation axle therefore runs in particular obliquely to the horizontal and preferably also encloses with the vertical an angle other than 0° and 90°. For example, it would be conceivable that the rotation axle is attached to a frame of the textile machine and extends downward therefrom in an inclined manner as far as the suction nozzle of the suction unit, so that the latter can be pivoted in a plane that is intersected both by the horizontal and by the vertical. The maximum pivot angle of the suction nozzle is moreover preferably between 20° and 180°, more preferably between 40° and 90°.

The object of the present invention can also be achieved by a textile machine characterized in that it is operatively connected to a control unit designed to operate the textile machine according to what has been described above and/or will be described below during a roving production start procedure. To this end, the control unit is preferably operatively connected to the drafting system, the consolidating means (if an air spinning nozzle is used as the consolidating means: to the air supply of the air spinning nozzle), the draw-off unit (if present), the suction unit (in particular the suction nozzle thereof and the associated negative pressure supply), and the tube drive, in order to operate the units in accordance with the method according to the invention and to carry out the appropriate steps in the manner according to the invention. Moreover, the textile machine may have one or more of the additional features described above or yet to be described below, provided that these do not contradict one another.

According to the present invention, the method for starting the roving production on a textile machine that serves to produce roving is characterized in that the roving produced by a consolidating means of the textile machine at the beginning of the start procedure is sucked up by a suction unit after leaving the consolidating means during ongoing roving production, in that the section of the roving running between the consolidating means and the suction unit is brought into contact with a rotating tube of a winding device, and in that the roving is then cut during ongoing roving production. The section of the roving that is located in the suction unit after the roving has been cut is ultimately conveyed away by the suction unit, whereas the section of the roving that is located between the consolidating means and the tube is wound onto the tube.

In other words, the core of the method according to the invention lies in the fact that the roving leaving the consolidating means at the start of roving production is firstly, that is to say prior to making contact with a provided tube, grasped by the suction unit. Thus, after leaving the consolidating means, the roving enters the region of the suction unit or the suction nozzle thereof and is sucked into the suction unit by means of negative pressure (the consolidating means therefore delivers roving which, after passing the consolidating means or, if a draw-off unit is present, after passing the draw-off unit, is sucked in by the suction unit, wherein the section that is sucked in is not wound onto the tube but rather is disposed of by the suction unit after being cut off from the rest of the roving leaving the consolidating means). Once the roving has been sucked up, the course of the roving is changed, for example by a traversing unit, such that the roving comes into contact with the tube and is wound up by the latter. After the roving has entered the active region of the tube, the roving section running between the tube and the suction unit is finally cut and the roving section on the suction unit side (that is to say the roving section located at least partially inside the suction unit after the cutting process) is disposed of by the suction unit. At the end of the start procedure, the roving still being delivered by the consolidating means extends between the consolidating means (or a draw-off unit optionally arranged downstream thereof) and the tube and can be wound onto the rotating tube according to the delivery speed of the consolidating means until the tube has the desired quantity of roving and has to be replaced by a new tube.

It is also advantageous if the section of the roving running between the consolidating means and the suction unit is transferred, before the roving is cut, from the suction unit to a traversing unit that then brings the roving into contact with the rotating tube. The movement of the roving in the direction of the tube is in this case brought about not or not only by the suction unit, but rather by the traversing unit, which preferably has a suitable guide section by which the roving is guided and moved in the direction of the tube.

It is also advantageous if the roving, during the start procedure, is brought into contact with the tube, preferably by means of a traversing unit, and in that the section of the roving then running between the tube and the suction unit is subjected to a tension that is generated preferably and at least partially by the suction unit and that brings about a cutting of the roving in the region between the tube and the suction unit. The aforementioned cutting of the roving section running between the consolidating means and the suction unit takes place in this case by means of the suction unit, which by virtue of the applied negative pressure exerts a tension on the roving that ultimately brings about a tearing of the roving. In this case, the tension can be briefly increased for the cutting process by varying the negative pressure. A movement of the suction nozzle of the suction unit in a direction away from the tube, in order to increase the tension, is also conceivable.

It is also advantageous if the roving is cut by means of a cutting unit, wherein the cutting unit is brought into contact with the roving after the roving has been transferred to a traversing unit and preferably after or during the contacting of the roving with the rotating tube. The cutting unit may comprise, for example, a cutting arm that is pivoted or moved in some other way into the course of the roving. It is critical that the roving enters into contact with the cutting arm or a cutting element thereof. A friction is thereby created between the roving and the cutting arm or cutting element, which brings about a short-term or abrupt decelerating of the roving. If the roving has already been grasped by the rotating tube, it is decelerated before being wound onto the tube. The resulting tension ultimately brings about a cutting or tearing of the roving in the region of the cutting element, so that the roving on the suction unit side (that is to say, the roving section that extends inside the suction unit after the cutting or tearing of the roving) is sucked up by the suction unit and the roving on the consolidating means side can (still) be wound onto the tube, wherein the roving on the consolidating means side extends between the consolidating means and the tube.

Advantages are moreover obtained if the circumferential speed of the tube at the moment at which the section of the roving running between the consolidating means and the suction unit is being brought into contact with the rotating tube is greater than (preferably at most 10% greater than) or equal to the roving delivery speed of the consolidating means. This is particularly useful when the tube is equipped at least partially with the abovementioned hooks (which may be present for example by virtue of a brush ring surrounding the tube). When the roving comes into contact with these hooks (or similar elements) of the tube, the speed of the latter is somewhat higher than the speed of the roving in this region. The hooks therefore pierce into the roving and thus securely grip the latter and fix it in the region of the tube surface.

It is also advantageous if the roving delivery speed of the consolidating means during the start procedure, at least temporarily and preferably at the moment at which the section of the roving running between the consolidating means and the suction unit is being brought into contact with the rotating tube, is of a magnitude that is at least 0.8 times, preferably at least 0.9 times, particularly preferably at least 0.95 times the roving delivery speed that is provided for normal operation of the textile machine following the start procedure. In other words, it may therefore be provided that the delivery speed of the roving (that is to say the speed of the roving leaving the consolidating means) has during the start procedure almost the magnitude or even the same magnitude as during the actual roving production, during which the roving is wound onto the tube after the start procedure until the tube has the predefined roving quantity or roving length. The efficiency of the textile machine is in this case particularly high since the delivery speed during the start procedure need not or need only insignificantly be reduced in comparison to the roving production. In addition, the start procedure can also be carried out in a particularly reliable manner since the delivery speed of the consolidating means need not be increased (or need only insignificantly to be increased) after the start procedure.

Finally, it is advantageous if, after the section of the roving running between the consolidating means and the suction unit has been brought into contact with the rotating tube, the circumferential speed of the tube is adjusted such that the section of the roving running between the consolidating means and the tube sags at least partially under the effect of gravity. It is therefore advantageous if the section, in particular the section running between the consolidating means or the draw-off unit (if present) and the tube or the section of the traversing unit guiding the roving, is exposed only to the tension that is brought about by the dead weight of the roving section in question. This can be monitored for example by one or more sensors that monitor the sag of the roving in this region. If the sag falls below a minimum stored in the control unit, the rotational speed of the tube can be reduced. If, on the other hand, a corresponding maximum is exceeded, then the rotational speed can be increased so that the roving always runs with particularly low tension and thus in a gentle manner between the consolidating means or the draw-off unit preferably arranged downstream thereof and the tube or the upstream traversing unit. An undesired tearing of the roving in this region is almost ruled out as a result.

BRIEF DESCRIPTION OF THE DRAWINGS

Further advantages of the invention are described in the following exemplary embodiments, in which.

DETAILED DESCRIPTION

Figure 1:
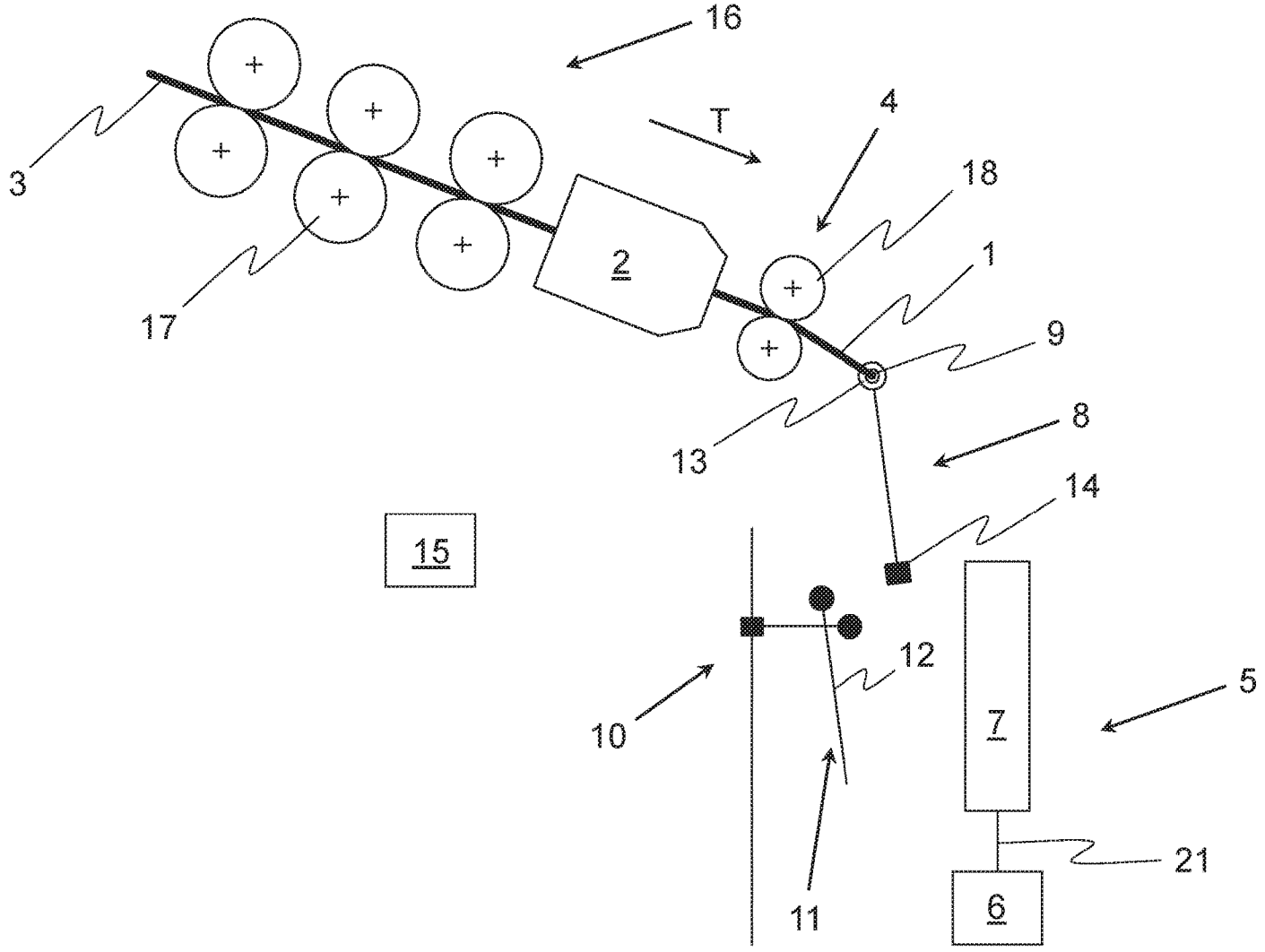
FIGS. 1 to 5 show a roving production start procedure according to the invention on a schematically shown textile machine according to the invention, in the form of an air-jet spinning machine, which serves to produce roving.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

First, it should be expressly pointed out that the air-jet spinning machine that is shown and described as an example of a textile machine according to the invention, as well as the illustrated components thereof, are not shown true to scale. Instead, the individual figures show only schematic diagrams which are intended to illustrate the basic structure of the respective assemblies. In particular, the mutual spacings and spatial relationships between the individual elements may differ from what is shown.

FIGS. 1 to 5 show a schematic view of part of a textile machine according to the invention in the form of an air-jet spinning machine, which serves to produce a roving 1, at different points in time during a roving production start procedure. The air-jet spinning machine may, if necessary, include a drafting system 16 comprising a plurality of corresponding drafting system rollers 17 (only one of the drafting system rollers 17 has been provided with a reference sign for clarity reasons), to which there is fed a fiber bundle 3, for example in the form of a doubled-over draw frame sliver. The illustrated air-jet spinning machine also comprises in principle a consolidating means, spaced apart from the drafting system 16, in the form of an air spinning nozzle 2 having an internal vortex chamber (known from the prior art and therefore not shown) in which the fiber bundle 3 or at least a portion of the fibers of the fiber bundle 3, is provided with a protective twist.

The air-jet spinning machine may also comprise a draw-off unit 4 including preferably two draw-off rollers 18, as well as a winding device 5 for the roving 1 arranged downstream of the draw-off unit 4 (the draw-off unit 4 is therefore not absolutely necessary). The winding device 5 in turn comprises preferably a tube drive 6 and a tube holder 21 connected to the tube drive 6, and is known in principle, by means of which a tube 7 can be fixed and set in a rotational movement by means of the tube drive 6.

The air-jet spinning machine operates according to a special air-jet spinning process. In order to form the roving 1, the fiber bundle 3 is guided in a transport direction T via an inlet opening (not shown) into the vortex chamber of the air spinning nozzle 2. There, it is given a protective twist, that is to say at least a portion of the fibers of the fiber bundle 3 is grasped by a swirled air flow that is created by suitably placed air nozzles. A portion of the fibers is thereby pulled at least a little way out of the fiber bundle 3 and is wound around the tip of a yarn forming element which protrudes into the vortex chamber.

Finally, the fibers of the fiber bundle 3 are drawn out of the vortex chamber via an inlet mouth of the yarn forming element and a draw-off channel arranged inside the yarn forming element and that adjoins the inlet mouth. In doing so, the free fiber ends are finally also drawn on a helical trajectory in the direction of the inlet mouth and wrap as wrapping fibers around the centrally running core fibers, resulting in a roving 1 that has the desired protective twist.

Due to the only partial twisting of the fibers, the roving 1 has a (residual) draftability that is essential for the further processing of the roving 1 in a downstream spinning machine, for example a ring spinning machine. Conventional air-jet spinning devices, on the other hand, give the fiber bundle 3 such a pronounced twist that the required drafting following yarn production is no longer possible. This is also desired in this case since conventional air-jet spinning machines are designed to produce a finished yarn, which is generally intended to be characterized by a high strength.

Before a tube 7 can be wound with roving 1, a start procedure must take place, during which the roving 1 leaving the air spinning nozzle 2 must be brought into contact with the tube 7. One possible start procedure according to the present invention is shown in FIGS. 1 to 5.

Firstly, a fiber bundle 3 is fed into the air spinning nozzle 2 by starting the drafting system 16. The above-described roving production, during which the fiber bundle 3 is given a protective twist, takes place in the air spinning nozzle 2. Finally, the roving 1 leaves the air spinning nozzle 2 via an exit opening 20 (FIG. 7) and is grasped by the air flow of a suction unit 8. The suction unit 8 preferably has a suction nozzle 13 with a suction opening 9, via which air and thus also the roving 1 leaving the air spinning nozzle 2 is sucked up or sucked in. In this stage shown in FIG. 1, therefore, the roving 1 produced by the air spinning nozzle 2 leaves the air spinning nozzle 2 and is sucked into the suction unit 8 via the suction opening 9 (which is located, for example, in the region of the draw-off unit 4 that is preferably present or in the region of the exit opening 20 of the air spinning nozzle 2, cf. FIGS. 6 and 7), wherein the delivery speed of the air spinning nozzle 2 preferably corresponds to the delivery speed prevailing after the start procedure or is only slightly lower (preferably at most 20% lower) than said speed.

In general, it should be noted at this point that the entire start procedure preferably takes place without any break in roving production or roving delivery, that is to say while the drafting system 16 is active, the air spinning nozzle 2 is active and, if present, the draw-off unit 4 is active (that is to say is drawing a roving 1 out of the air spinning nozzle 2), so that a particularly high efficiency of the illustrated air spinning machine can be ensured.

An illustrated control unit 15 is also provided, which is operatively connected to the described elements of the air-jet spinning machine in order to carry out the roving production start procedure according to the invention. The control unit 15 may be present for each spinning position of the air-jet spinning machine. It is also conceivable that one control unit 15 is responsible for a plurality of spinning positions.

In the next step (see FIG. 2), the suction unit 8 is moved (preferably pivoted about a pivot axle or rotation axle 14) into a transfer position in which the suction opening 9 and thus also a section of the roving 1 (which is moreover still being delivered by the air spinning nozzle 2) are located in the region of the tube surface. Contact between the tube 7 and the roving 1 preferably does not yet exist at this stage.

Figure 2:
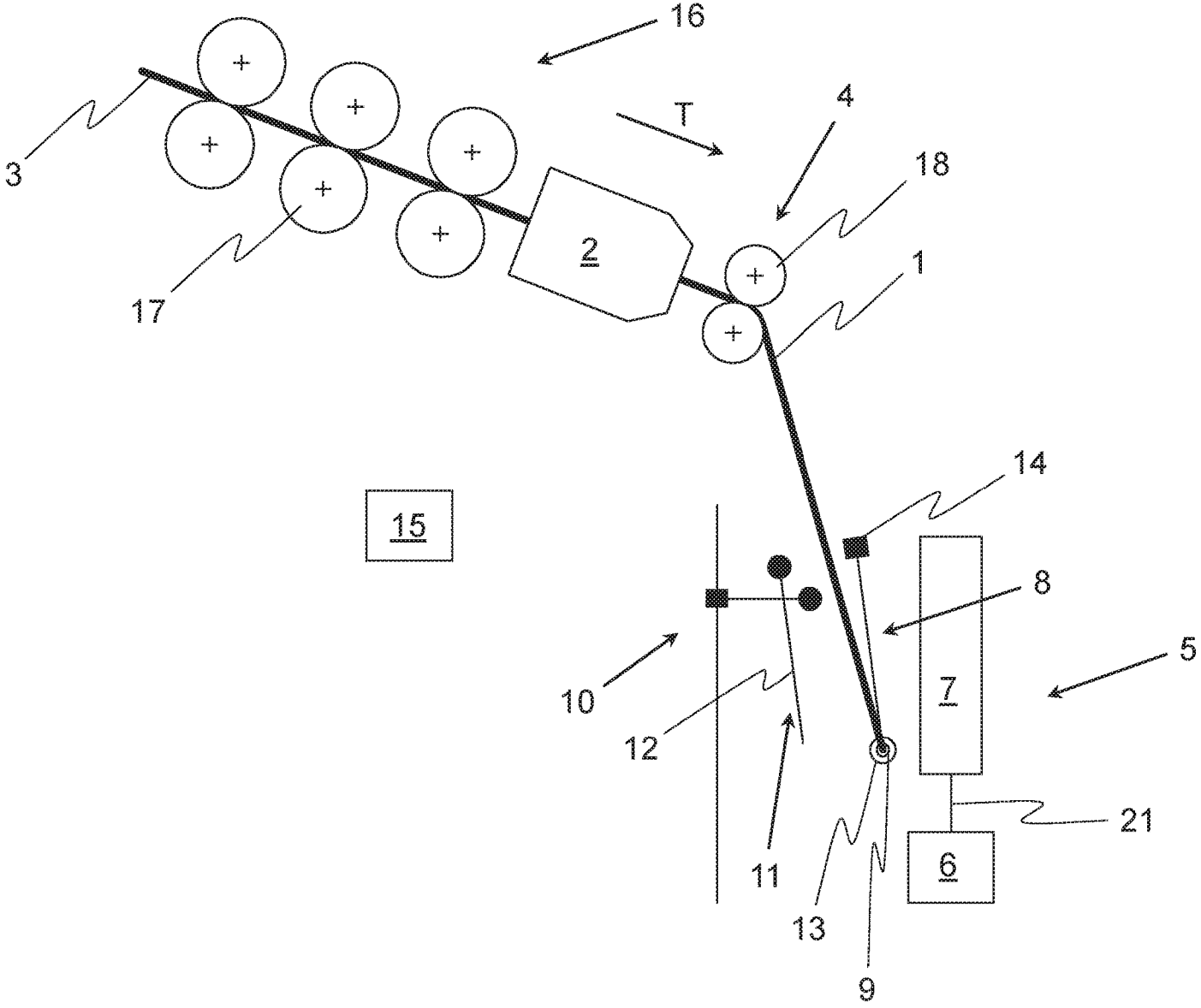
Figure 3:
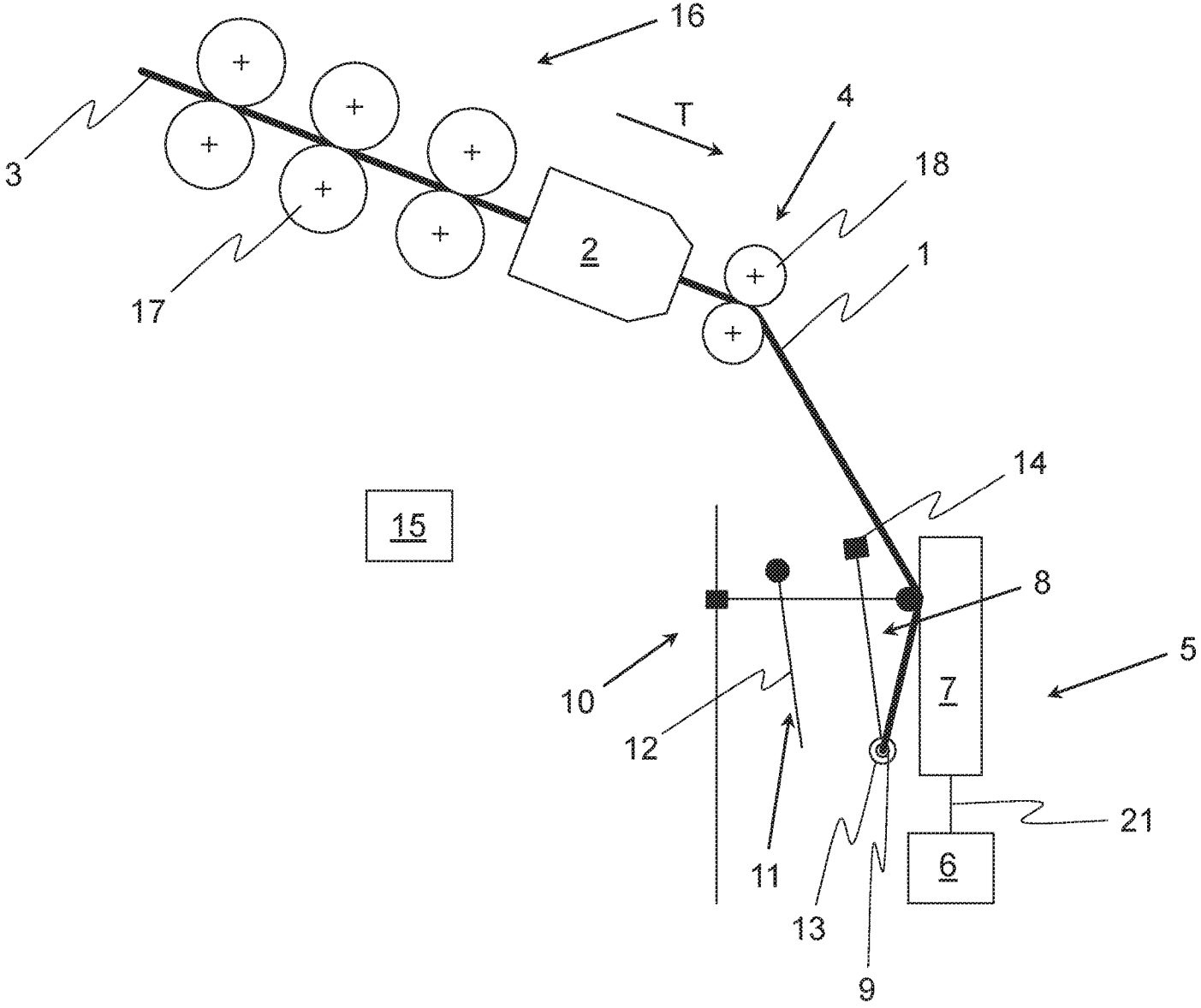
Figure 4:
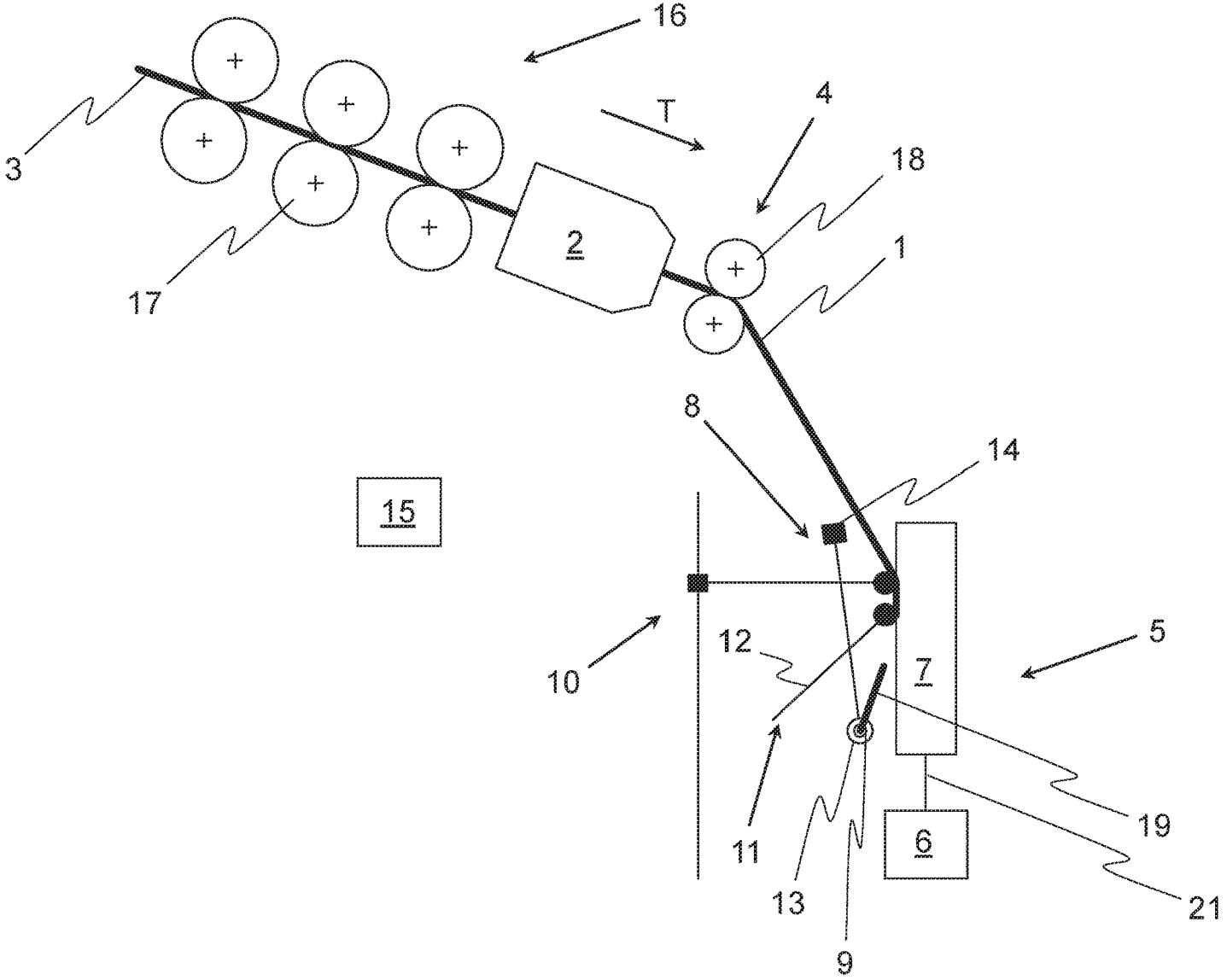

While the suction unit 8 is assuming its position shown in FIG. 2 (or shortly thereafter), the traversing unit 10 is moved into the position shown schematically in FIG. 3, in which the roving 1 is grasped and guided by the traversing unit 10. The traversing unit 10 thereby moves the roving 1 into the vicinity of the tube 7 or brings about direct contact between the tube 7 and the roving 1, during which the roving 1 (preferably under the effect of suitable rough surface sections of the tube 7) is grasped by the tube 7.

At the same time or shortly thereafter, a cutting unit 11 is finally activated, which comprises for example a movable (preferably pivotable) cutting arm 12. The cutting unit 11 is thereby brought into contact with the roving 1, preferably with the section thereof that is located between the traversing unit 10 and the suction opening 9. At this moment, a local decelerating of the roving 1 occurs in the region that comes into contact with the cutting unit 11, so that the roving 1 finally tears between the tube 7 and the cutting element since it continues to be wound up by the rotating tube 7, that is to say has a tension applied to it (see FIG. 4). Due to the tearing of the roving 1, a section of the roving 1 on the suction unit side is obtained, which is conveyed away via the suction unit 8 (the section of the roving 1 that is located in the suction unit 8 after the cutting of the roving 1 is provided with reference number 19 in FIG. 4). A roving section on the air spinning nozzle side is also obtained, which is already grasped by the tube 7 and extends between the air spinning nozzle 2 and the tube 7.

Figure 5:
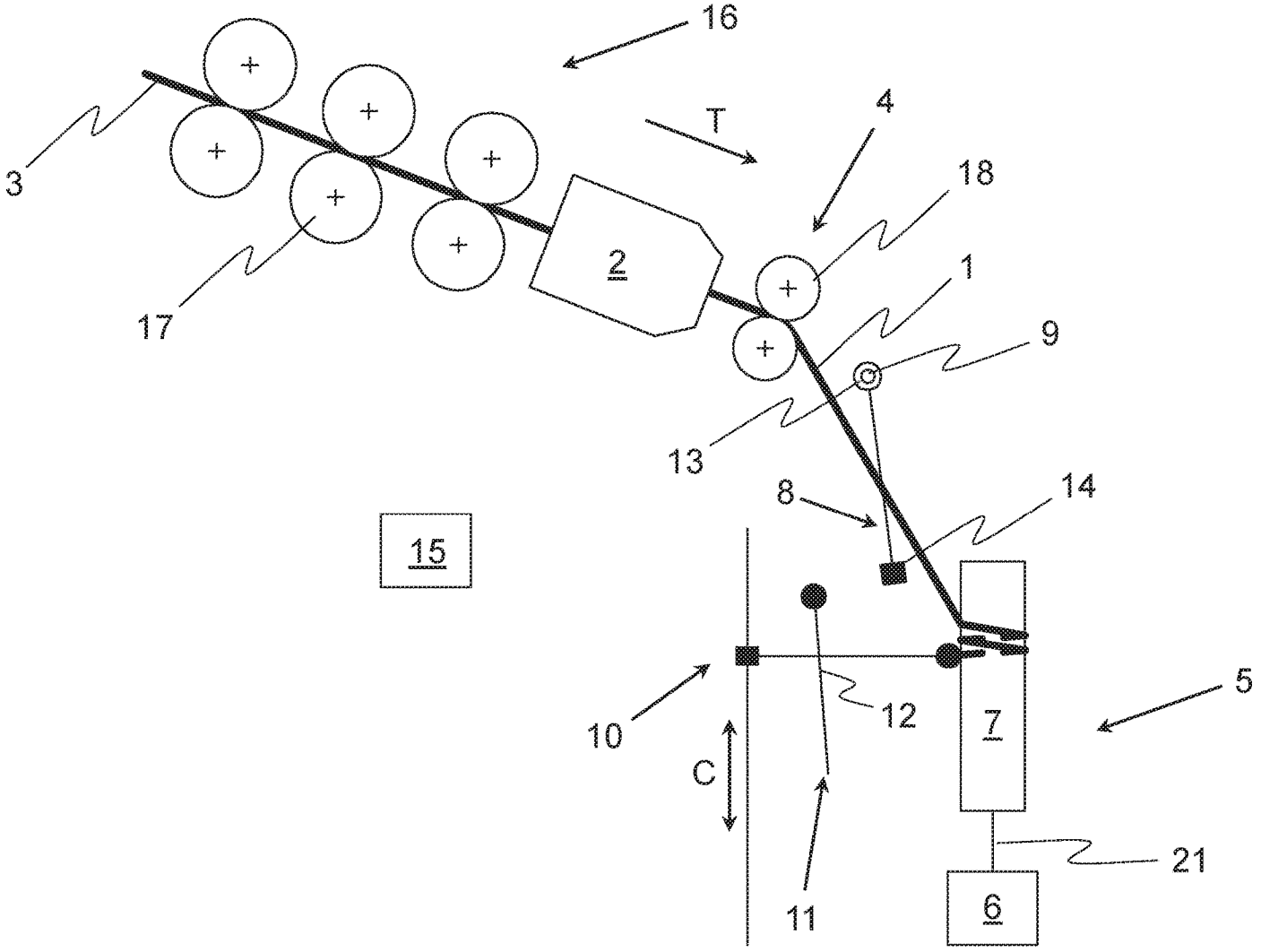

By virtue of the further rotation of the tube 7, the roving 1 still being delivered by the air spinning nozzle 2 is continuously wound onto the tube 7, wherein the traversing unit 10, by virtue of a movement in the direction of the rotation axle of the tube 7 (see arrow C), ensures that the roving 1 is uniformly wound onto the tube 7 (see FIG. 5). At this stage in which the cutting unit 11 and also the suction unit 8 have assumed their original positions, the air-jet spinning machine is finally in its normal operating mode following the start procedure, in which normal operating mode the tube 7 is wound with roving 1 until the desired bobbin size is achieved.

Figure 6:
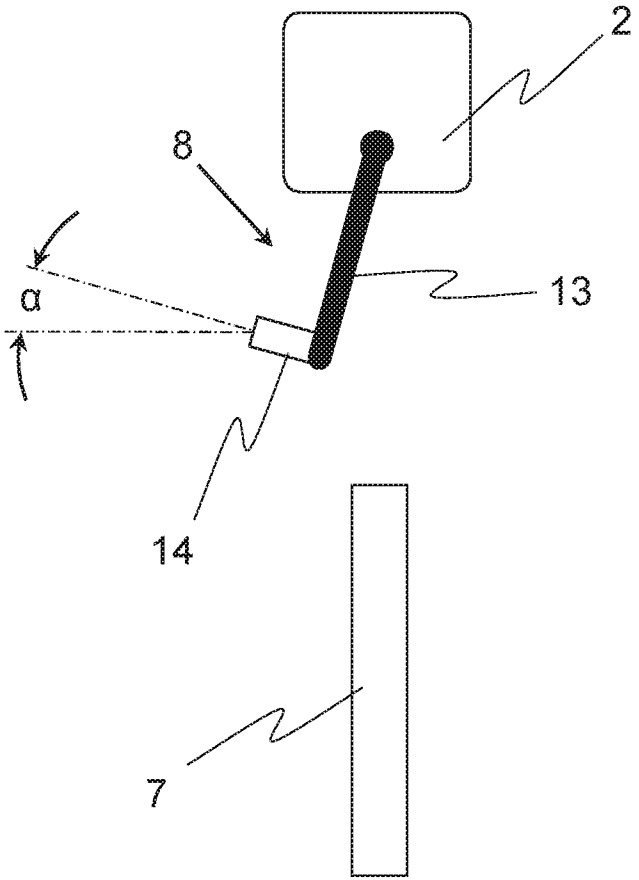
FIGS. 6 and 7 show a front view of a suction unit of a textile machine according to the invention, in the form of an air-jet spinning machine, in two different positions.
Figure 7:
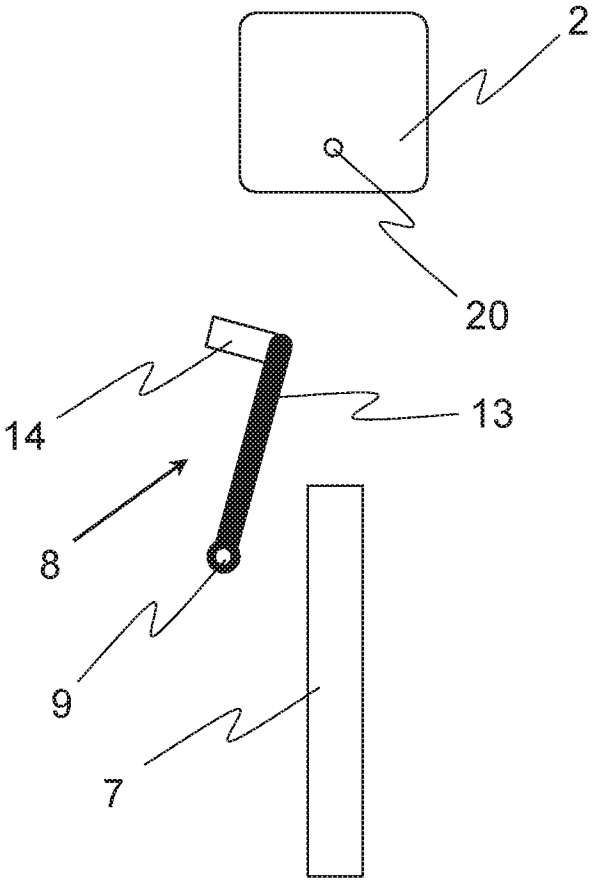

One advantageous embodiment of the suction unit 8 or the suction nozzle 13 thereof is shown in FIGS. 6 and 7, wherein FIG. 6 shows the sucking position (that is to say the position in which the roving 1 is being sucked up after leaving the exit opening 20 of the air spinning nozzle 2—cf. FIG. 1) and FIG. 7 shows the transfer position (that is to say the position shown in FIG. 2, in which the roving 1 has been moved into the vicinity of the tube 7) (the roving 1 is not shown in FIGS. 6 and 7).

As can be seen from these figures, it may be advantageous if the suction nozzle 13 of the suction unit 8 is mounted such as to be able to move about a rotation axle 14 which encloses with the horizontal an angle $\alpha$ which is other than 0° and is for example between 0° and 30°, preferably between 0° and 20°, particularly preferably between 0° and 15°. The suction nozzle 13 can thus be pivoted obliquely downward in order to position the roving 1 to the side of the tube 7.

The present invention is not limited to the exemplary embodiments that have been shown and described. Modifications within the scope of the claims are also possible, as is any combination of the described features, even if they are shown and described in different parts of the description or the claims or in different exemplary embodiments.

LIST OF REFERENCE SIGNS

1 roving
2 air spinning nozzle
3 fiber bundle
4 draw-off unit
5 winding device
6 tube drive
7 tube
8 suction unit
9 suction opening
10 traversing unit
11 cutting unit
12 cutting arm
13 suction nozzle
14 rotation axle
15 control unit
16 drafting system
17 drafting system roller
18 draw-off roller
19 section of the roving that is located in the suction unit after the roving has been cut
20 exit opening
21 tube holder
T transport direction
$\alpha$ angle between the rotation axle of the suction nozzle and the horizontal

The invention claimed is:

1. A textile machine for producing a roving, comprising:
a consolidating means for producing a roving having a protective twist from a fiber bundle;
a winding device arranged downstream of the consolidating means in a transport direction of the roving;
a tube driven by a tube drive, the winding device configured to wind the roving onto the tube;
an arrangement disposed to bring the roving leaving the consolidating means during a roving production start procedure into contact with the tube, the arrangement comprising:
a movably mounted suction unit with a suction opening that is configured to suck up the roving during ongoing roving production;
means for bringing the roving running between the consolidating means and the suction opening into contact with the tube during ongoing roving production;
means for cutting the roving such that a section of the roving grasped by the suction unit is conveyed away by the suction unit and a section of the roving running between the consolidating means and the tube is wound onto the tube;
wherein the cutting means comprises a movably mounted cutting unit that is movable from a resting position in which the cutting unit is not in contact with the roving during the start procedure to a cutting position in which the cutting unit comes into contact with and cuts the roving; and
wherein in the cutting position, the cutting unit is brought into contact with the tube and presses the roving against the tube surface.

2. The textile machine according to claim 1, wherein the consolidating means comprises an air spinning nozzle, wherein the roving having the protective twist is produced from the fiber bundle by a swirled air flow within the air spinning nozzle.

3. The textile machine according to claim 1, further comprising a draw-off unit arranged downstream of the consolidating means in the transport direction of the fiber bundle to draw off the roving from the consolidating means, wherein the roving, during ongoing roving production, is sucked up by the suction unit after passing the draw-off unit, wherein the roving running between the draw-off unit and the suction opening is brought into contact with the tube during ongoing roving production, and wherein the roving, during ongoing roving production, is cut such that the section of the roving grasped by the suction unit is conveyed away by the suction unit and the section of the roving running between the draw-off unit and the tube is wound onto the tube.

4. The textile machine according to claim 1, wherein the bringing means comprises a traversing unit disposed so as to grasp the section of the roving running between the consolidating means and the suction opening during the start procedure and to move the roving to the tube.

5. The textile machine according to claim 1, wherein the cutting unit comprises a movable cutting arm.

6. The textile machine according to claim 1, wherein the suction unit comprises a suction nozzle that defines the suction opening, the suction nozzle pivotable about a rotation axle that encloses an angle $\alpha$ of between 0° and 30° with a horizontal plane.

7. The textile machine according to claim 1, further comprising a control unit in communication with the arrangement.

8. A method for operating a textile machine to produce roving, comprising:

at a beginning of a start procedure wherein the roving is produced by a consolidating means of the textile machine during ongoing roving production, the roving is sucked up by a suction unit after leaving the consolidating means;

a section of the roving running between the consolidating means and the suction unit is brought into contact with a rotating tube of a winding device; and the roving is subsequently cut such that a section of the roving located in the suction unit after the roving has been cut is conveyed away by the suction unit, and a section of the roving that is located between the consolidating means and the tube is wound onto the tube.

9. The method according to claim 8, wherein the consolidating means comprises an air spinning nozzle and the roving is produced by a swirled air flow inside the air spinning nozzle.

10. The method according to claim 8, wherein, before the roving is cut, the section of the roving running between the consolidating means and the suction unit is transferred from the suction unit to a traversing unit that brings the roving into contact with the tube.

11. The method according to claim 10, wherein the section of the roving running between the tube and the suction unit is subjected to a tension generated at least partially by the suction unit that results in a cutting of the roving between the tube and the suction unit.

12. The method according to claim 10, wherein the roving is cut by a cutting unit that is brought into contact with the roving after the roving has been transferred to the traversing unit and after or during contacting of the roving with the tube.

13. The method according to claim 12, wherein when the section of the roving running between the consolidating means and the suction unit is brought into contact with the tube, a roving delivery speed of the consolidating means during the start procedure is at least 0.8 times the roving delivery speed for normal operation of the textile machine following the start procedure.

14. The method according to claim 13, wherein after the section of the roving running between the consolidating means and the suction unit has been brought into contact with the rotating tube, a circumferential speed of the tube is adjusted such that the section of the roving running between the consolidating means and the tube sags under the effect of gravity.

* * * * *